US006879289B2

(12) United States Patent
Hayes

(10) Patent No.: US 6,879,289 B2
(45) Date of Patent: Apr. 12, 2005

(54) APPARATUS FOR PROVIDING A CONTROLLABLE SIGNAL DELAY ALONG A TRANSMISSION LINE

(75) Inventor: David Hayes, Winchester (GB)

(73) Assignee: Plasma Antennas, Ltd., Oxfordshire (GB)

( * ) Notice: Subject to any disclaimer, the term of this patent is extended or adjusted under 35 U.S.C. 154(b) by 0 days.

(21) Appl. No.: 10/475,578

(22) PCT Filed: Apr. 26, 2002

(86) PCT No.: PCT/GB02/01925

§ 371 (c)(1),
(2), (4) Date: Oct. 23, 2003

(87) PCT Pub. No.: WO02/089250

PCT Pub. Date: Nov. 7, 2002

(65) Prior Publication Data

US 2004/0130491 A1 Jul. 8, 2004

(30) Foreign Application Priority Data

Apr. 26, 2001 (GB) ..... 0110298

(51) Int. Cl.[7] ..... H01Q 1/38

(52) U.S. Cl. ..... 343/700 MS; 343/770; 343/909; 333/161; 385/14

(58) Field of Search ..... 343/700 MS, 701, 343/753, 754, 767, 770, 909; 385/5, 14, 15; 333/116, 117, 161

(56) References Cited

U.S. PATENT DOCUMENTS 5,222,162 A * 6/1993 Yap et al. ..... 385/14
5,227,808 A 7/1993 Davis
5,349,364 A * 9/1994 Bryanos et al. ..... 343/853
5,472,935 A * 12/1995 Yandrofski et al. ..... 505/210
5,694,134 A 12/1997 Barnes
5,694,498 A 12/1997 Manasson et al.
5,894,288 A * 4/1999 Lee et al. ..... 343/770
5,982,334 A 11/1999 Manasson et al.
6,169,594 B1 * 1/2001 Aye et al. ..... 349/196
6,313,803 B1 * 11/2001 Manasson et al. ..... 343/756
6,621,459 B2 * 9/2003 Webb et al. ..... 343/754
6,812,903 B1 * 11/2004 Sievenpiper et al. ..... 343/753

FOREIGN PATENT DOCUMENTS

WO WO 02 01671 3/2002

OTHER PUBLICATIONS

Alphones et al., "Leaky wave radiation of millimeter waves by photoinduced plasma grating in a semiconductor slab" IEE Proceedings: Microwaves, Antennas And Propagation, IEE, Stevenage, Herts, GB, vol. 146, No. 1, Feb. 9, 1999, pp. 77–83, XP006013520, ISSN: 1350–2417 p. 77, pp. 81–82.

* cited by examiner

*Primary Examiner*—Tho Phan
(74) *Attorney, Agent, or Firm*—Iandiorio & Teska

(57) ABSTRACT

Apparatus for providing a controllable signal delay along a transmission line, which apparatus comprises a transmission line conductor on a dielectric medium comprised wholly or partially or a semiconductor material, and adjacent periodically separated electromagnetically-coupled elements, the coupling between the elements and the transmission line conductor being controllable through photonic and/or electrical injection of electrical carriers into the dielectric medium, whereby the apparatus is such as to enable control of the velocity of electromagnetic propagation along the transmission line and thereby through the apparatus.

14 Claims, 9 Drawing Sheets

Controllable Delay Line Structure incorporating Dielectrically Controlled Slot Arrays Corporate Feed Structure for a Slow-Wave Plasma Antenna.

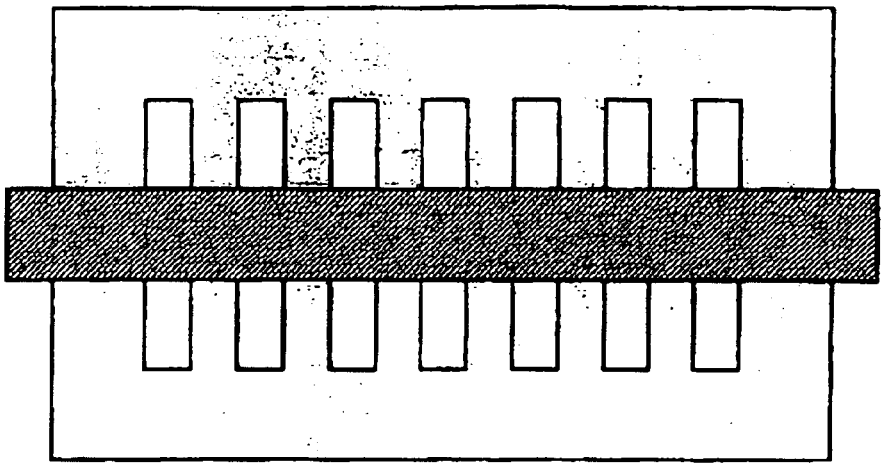
Figure 1 - Fixed Delay Line Structure incorporating Slot Arrays in the Ground Plane.

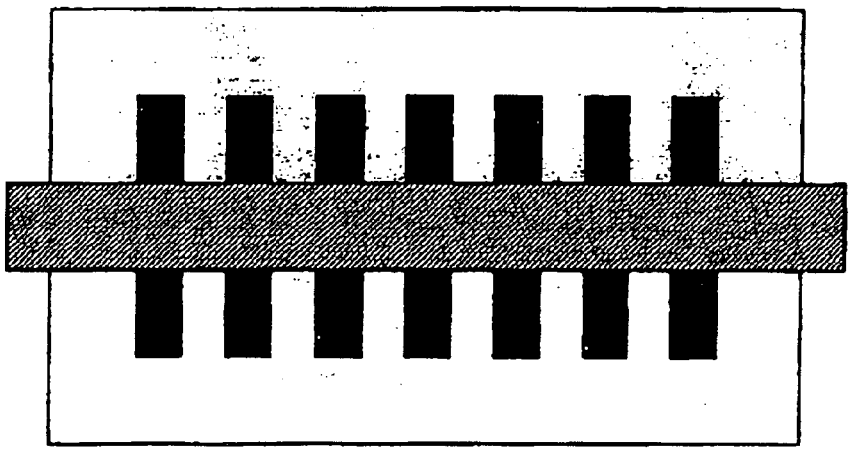
Figure 2 Controllable Delay Line Structure incorporating Dielectrically Controlled Slot Arrays

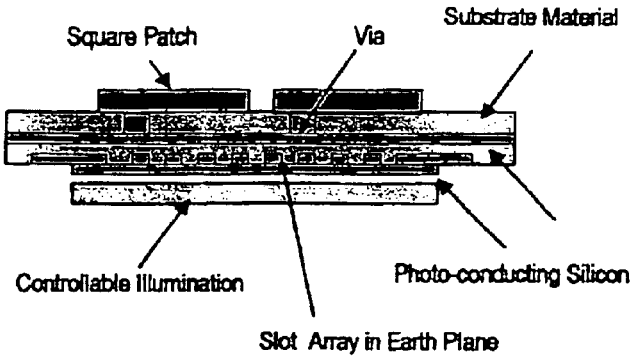
Figure 3A.
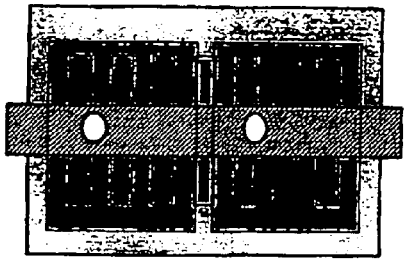
Figure 3B.
Figure 3 Linear Structure for a Slow-Wave Plasma Antenna.
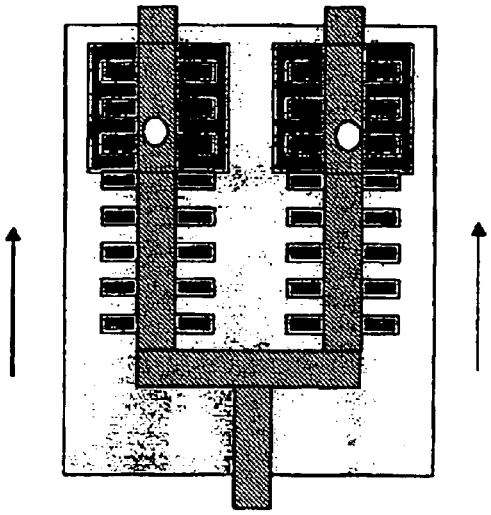
Figure 4 Corporate Feed Structure for a Slow-Wave Plasma Antenna.

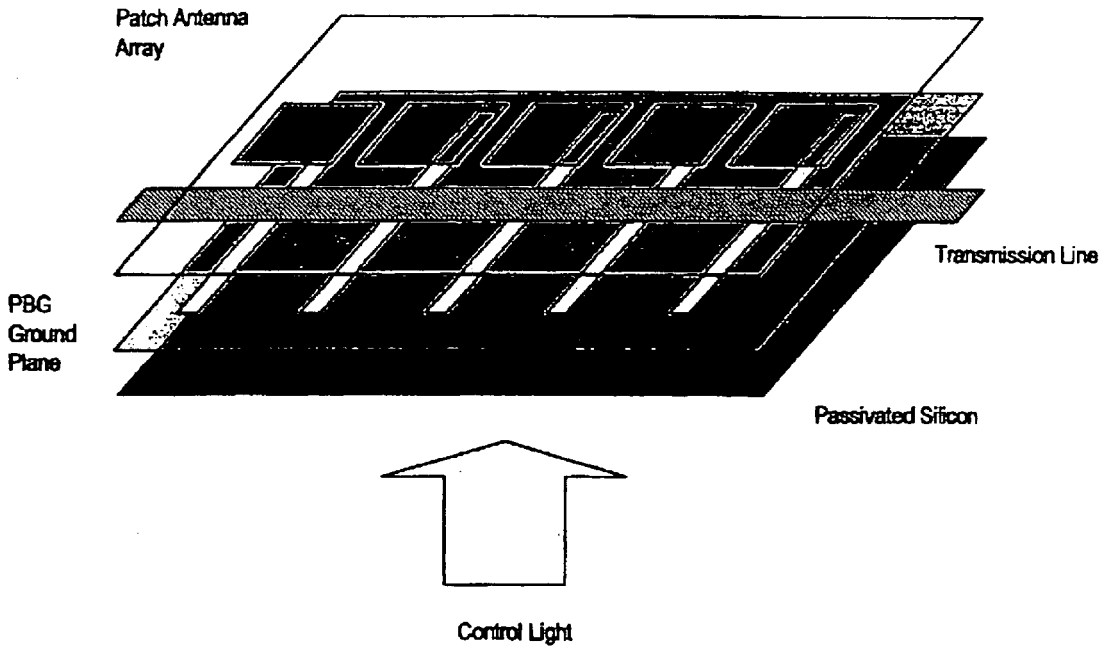
Figure 5 Controllable 'Slow-Wave Scanned' Antenna (space coupled).

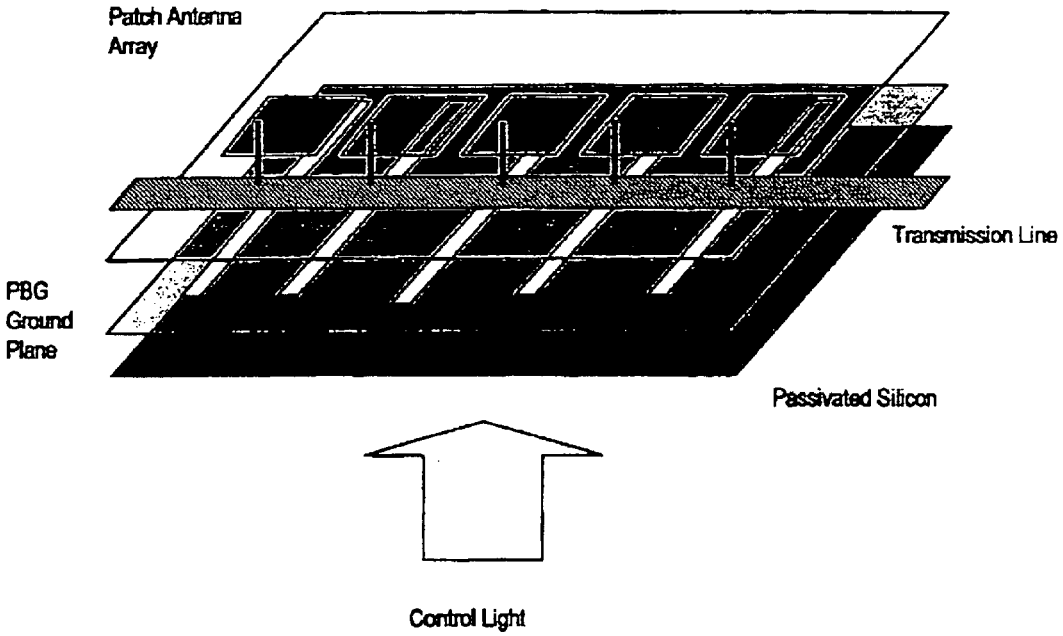
Figure 6 Controllable 'Slow-Wave Scanned Antenna' (coupled by vias).

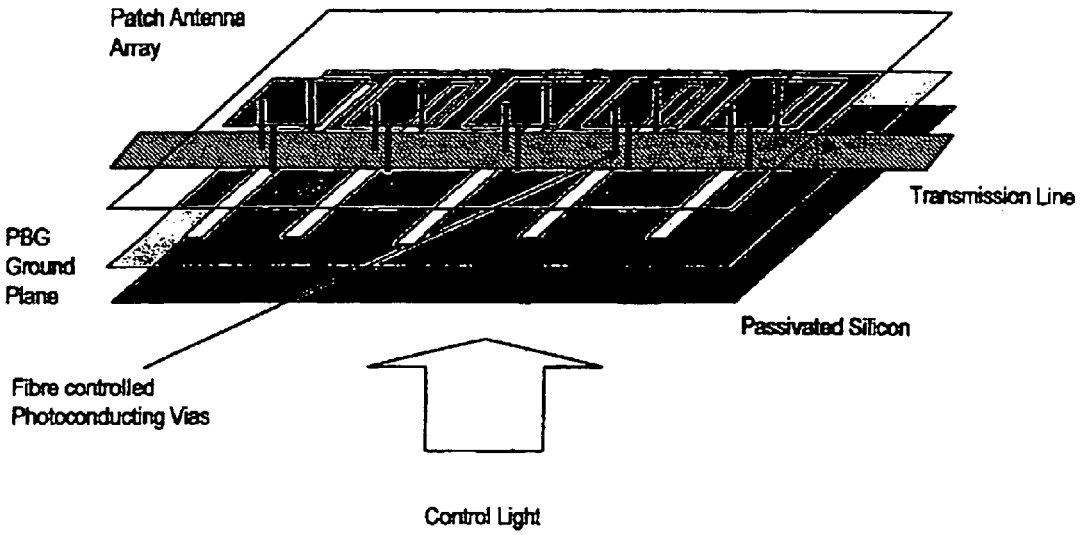
Figure 7 Controllable Polarisation 'Slow-Wave Scanned' Antenna (coupled by photoconducting vias).

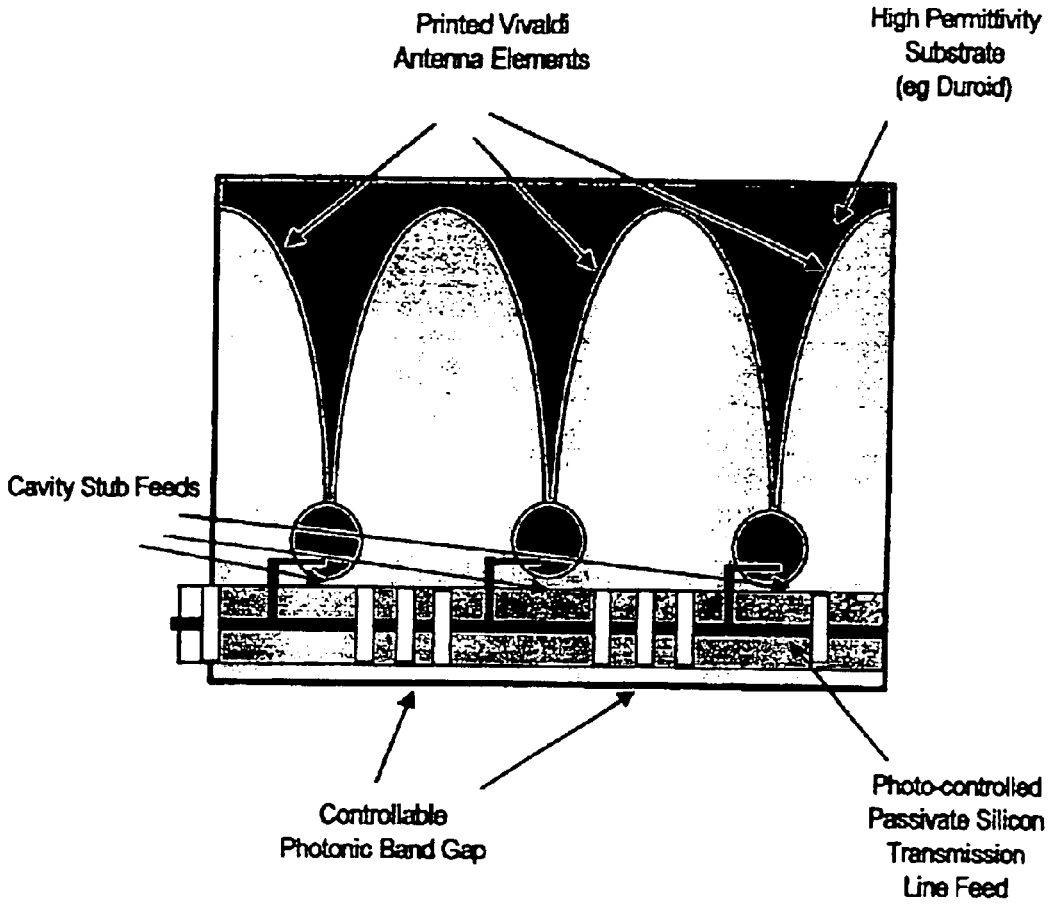
Figure 8 Tri-Plate, PBG Steered, Vivaldi Array

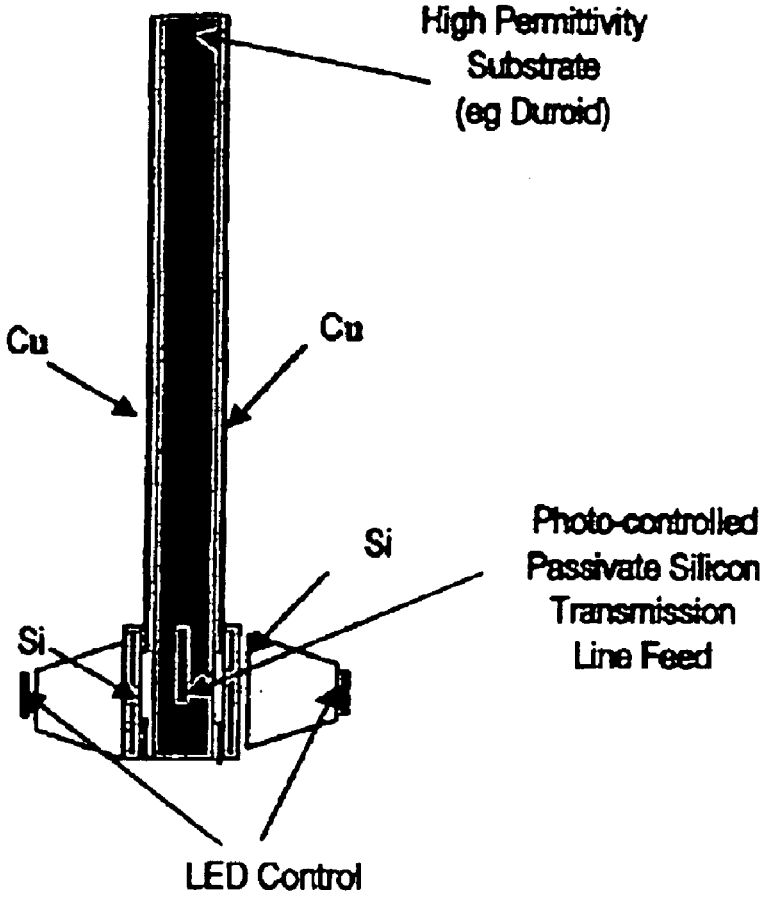
Figure 9 Tri-Plate, PBG Steered, Vivaldi Array (side-on)

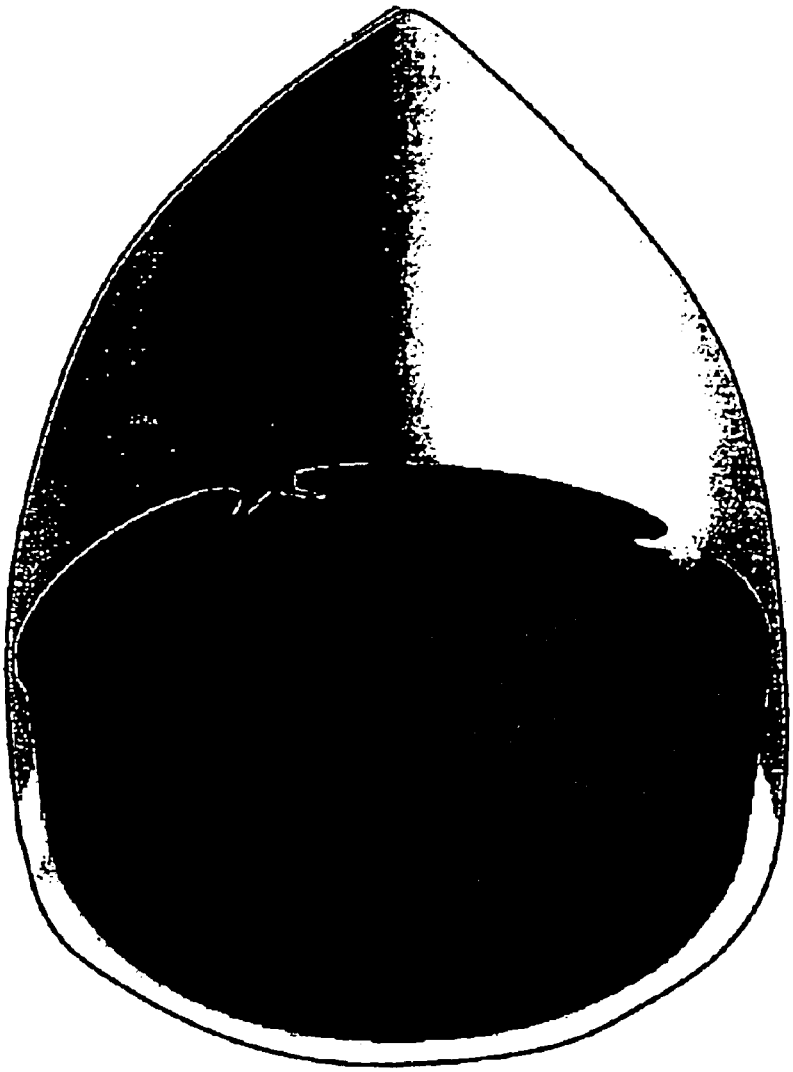
Figure 10 Monopulse PBG Slow-Wave Antenna.

APPARATUS FOR PROVIDING A CONTROLLABLE SIGNAL DELAY ALONG A TRANSMISSION LINE

FIELD OF THE INVENTION

This invention relates to apparatus for providing a controllable signal delay along a transmission line. The apparatus enables the adaptive control of the propagation velocity of electromagnetic radiation through a composite transmission line structure.

BACKGROUND OF THE INVENTION

Electromagnetic radiation may be confined and directed effectively by means of known transmission line structures such for example as microstrip structures. The transmission line structures generally have a narrow conducting strip or strips separated from a larger ground plane by an intermediate dielectric medium. The electromagnetic propagation characteristics are determined by the physical dimension of the conducting strip or strips, and the thickness and electrical properties of the dielectric medium. The propagation velocity along the transmission line structure, for example the microstrip, is determined not only by the geometry of the transmission line structure, but also by the influence of any elements that may be electromagnetically coupled periodically to the transmission line. Conventionally, propagation delay may be controlled incrementally through the incorporation of extended lengths of line, typically in coiled or meander form. The overall propagation delay is determined through switches to direct the passage of propagated energy along selected lines.

DESCRIPTION OF THE PRIOR ART

It is known that intrinsic semiconductor materials may be doped with impurities to produce materials having precisely controlled conductivity. Light of sufficiently short wavelengths, as may be determined by the bandgap characteristic of the semiconductor material may be used locally to increase the density of free carriers and then the conductivity in the semiconductors. It is known that the intensity of an optical illumination changes the complex refractive index of semiconductors. Altematively, known PIN semiconductor structures may also be used to inject electrical carriers into a semiconductor medium to create a pattern of localized regions of high carrier density.

BRIEF DESCRIPTION OF THE INVENTION

The present invention provides in one non-limiting embodiment apparatus for providing a controllable signal delay along a transmission line, which apparatus comprises a transmission line conductor on a dielectric medium comprised wholly or partially of a semiconductor material, and adjacent periodically separated electromagnetically-coupled elements, the coupling between the elements and the transmission line conductor being controllable through photon and/or electrical injection of electrical carriers into the dielectric medium, whereby the apparatus is such as to enable control of the velocity of electromagnetic propagation along the transmission line and thereby through the apparatus.

The present invention advantageously enables delay to be progressively controlled through localized optical and/or electrical stimulation of the dielectric medium placed in or around a ground plane.

In the present invention, optical illumination means and/or electrical current injection means may be used to increase locally the carrier density within a semiconductor volume, thereby to produce a conducting plasma. The plasma is able to be well confined to the volume acted upon. The plasma is able to distinguish rapidly in the absence of the activation, that is the illumination or the electrical bias.

The locally defined plasma may be used firstly to make a hitherto insulating semiconducting medium into a conducting medium, and secondly to provide a selected electromagnetic feed to an electric dipole or similar electromagnetic element within the semiconducting medium.

The apparatus is preferably one in which the transmission line conductor is a microstrip conductor. The microstrip conductor may have a structure comprising a thin metallic guide separated from a ground plane by the dielectric medium.

Alternatively, the transmission line conductor may be an image line conductor, a fin line conductor, a slot line conductor, a co-planer waveguide conductor, an inverted microstrip conductor, a trapped inverted microstrip conductor, or a suspended strip line conductor. Other types of transmission line conductors may be employed if desired. Generally, the dielectric medium may be comprised wholly or partially of the semiconductor material. Thus the dielectric medium may be a composite structure which includes the semiconductor material.

The apparatus of the present invention may typically comprise a basic microstrip line with periodic coupling to non-resonant adjacent structures. These adjacent structures or elements may be, for example, slots in the ground plane, or other such forms. The apparatus of the present invention allows the degree of coupling to the adjacent elements to be dynamically controlled, thereby enabling the apparatus to act as a continuously variable microwave slow wave structure.

Preferably, the coupled elements are configured as arrays of slots or other such forms. The coupled elements may be in a pattern which is such as to produce a controllable electromagnetic band-stop or band-pass filter.

The apparatus may be used to excite an array of antenna elements, thereby enabling controllable directivity of the array of antenna elements. The coupling to the antenna elements may be enabled through locally generated filamentary plasmas. The apparatus may include optical means and/or electrical means for generating locally generated filamentary plasma. The optical means may illuminate the dielectric medium. The electrical means may inject electrical carriers into the semiconductor dielectric medium.

The electromagnetic polarisation of the antenna may be selectable through control of the coupling to the antenna elements.

The apparatus may be incorporated within a multiplicity of antenna sub-arrays, the collective effect of the sub-arrays enabling complex controllable antenna functionality.

The apparatus may be designed by calculation of geometry and material properties to perform in specific applications relating to telecommunications, radar, guidance, aerospace, medical scanning, inspection or other forms of sub-surface imaging.

BRIEF DESCRIPTION OF THE DRAWINGS

Embodiments of the invention will now be described solely by way of example and with reference to the accompanying drawings in which:

FIG. 1 illustrates a fixed delay line structure incorporating slot arrays in a ground plane;

FIG. 2 illustrates a controllable delay line structure incorporating dielectrically controlled slot arrays;

FIG. 3*a* is a section illustrating a linear structure for a slow wave plasma antenna;

FIG. 3*b* is a plan view of part of the linear structure shown in FIG. 3*a;*

FIG. 4 illustrates a corporate feed structure for a slow wave plasma antenna;

FIG. 5 illustrates a controllable slow wave scanned antenna which is space coupled;

FIG. 6 illustrates a controllable slow wave scanned antenna which is couple by vias;

FIG. 7 illustrates a polarisation slow wave scanned antenna which is coupled by photo conducting vias;

FIG. 8 illustrates a triplate photonic band gap steered, Vivaldi array;

FIG. 9 is a side view of the array shown in FIG. 8; and

FIG. 10 shows a monopulse photonic band gap slow wave antenna.

DETAILED DESCRIPTION OF THE DRAWINGS

FIG. 1 shows an example of a known fixed delay line structure. More specifically, FIG. 1 shows a fixed delay line structure incorporating slot arrays in a ground plane.

FIG. 1 illustrates the basic principle of operation in which a slow wave delay line utilises the property that the speed of propagation along a microstrip line is determined not only by the electrical properties of the substrate incorporated, but also by any adjacent electromagnetic structures or patterns to which energy may be coupled. The geometrical size and disposition of such adjacent features are such that they may be near resonance or non-resonant at frequencies of operation, and are periodically (or near periodically) positioned along the length of the delay line. Typically, the elements may have the form of slots in or around the ground plane. Such patterned electromagnetic structures have been referred to as electromagnetic band-gap (EBG) transmission lines.

The essence of the present invention is to modify in shape or permittivity the above mentioned patterned electromagnetic structures through the localised injection of carriers within a dielectric medium comprised wholly or partially of semiconducting material. The electromagnetic shape or influence of these carriers may be controlled by photon and/or electrical means for varying the localised carrier density within the semiconductor medium. Typical examples of suitable semiconductor materials include doped single elements such as silicon or germanium, or compound semiconductors including binary elements such for example as gallium arsenide and indium phosphide, or known tertiary compounds such for example as gallium aluminum arsenide. Furthermore, large area and low cost dielectric media may be realised through amorphous semiconductor material.

Referring now to FIG. 2, there is shown a structure equivalent to that shown in FIG. 1 incorporating photon or electrical means for varying the electromagnetic influence of the periodic elements. The modified (shaded) areas of FIG. 2 may be subjected to injection of carriers, thereby to influence the effect of the coupled elements and thence the speed of propagation. FIG. 2 shows schematically the means by which a low cost controllable delay line structure may be implemented.

Referring now to FIGS. 3*a* and 3*b*, there is shown a linear structure for a slow wave plasma antenna. The various components of the linear structure are as stated in FIG. 3*b*. FIG. 4 shows a corporate feed structure for a slow wave plasma antenna. FIGS. 3*a*, 3*b* and 4 are illustrative examples of the application of a controlled delay line to effect a steerable antenna. Patch antennas fed through electrical feeds or so-called "vias" are excited at relatively delay phases through the control of the underlying patterned electromagnetic delay line structure.

FIG. 5 shows a controllable slow wave scanned antenna which is space coupled. FIG. 5 is an example of a slot array antenna incorporating photon control. The various parts of the antenna are as stated in FIG. 5. As shown in FIG. 5, a transmission line is suspended above a photon band gap ground plane, and below a linear array of resonant patch antennas. The electromagnetic band gap ground plane has a linear array of non-resonant (or near resonant) apertures under which lies a thin layer of silicon. Under unstimulated conditions, the coupling between the apertures in the ground plane leads to slow wave propagation. However, when the apertures are effectively closed by illumination of light at an appropriate energy, the speed of propagation is increased. Thus, the intensity of the optical illumination (or level of current injection for the direct carrier injection case) may be used to control the speed of propagation along the length of the transmission line. Alternatively, selective illumination of the photo conducting slot (or selective current injection on or around the slot) may be used to change the speed of propagation. Patch antennas above the transmission line also couple strongly to the line, are highly resonant, and radiative. Controlled beam steering is achieved by advancing or retarding the signal to each patch by control of the local illumination.

FIG. 5 may be regarded as showing a slow wave scanned antenna with space coupled patch antennas. Meandered transmission lines may be incorporated when long relatively delays are required for extreme angular coverage. Coupling to the patch antennas may be enhanced through the incorporation of direct feeds (vias) between the transmission lines and the patches. FIG. 6 illustrates the concept of a controllable slow wave scanned antenna with direct coupling by vias.

FIG. 4 mentioned above illustrated an example of direct coupling between a slow wave patterned electromagnetic structure and period patch antennas. The feed point of the patch antenna may advantageously be selected in order to control the electromagnetic matching and polarisation of the radiative energy. Particular geometric coordinates within the patch antenna may be used to excite polarisation modes such as vertical, horizontal, diagonal, left and right circular. One means of selectively controlling polarisation is to generate the appropriate via feed through local carrier injection. FIG. 7 shows a schematic representation of an optical fibre means to address selective feed points using conducting vias. More specifically, FIG. 7 shows a controllable polarisation slow wave scanned antenna coupled by photo conducting vias. The various components of the antenna are as stated in FIG. 7.

In the above description with reference to FIG. 1 and FIG. 2, reference was made to a means for implementation of a controllable delay by photon means. The coupled periodic elements described are typically electrically "short" in the direction of propagation. There is thus significantly less length in that direction than one-half of the electromagnetic wavelength in the medium. In an alternative implementation of the present invention, the coupled periodic elements may be designed such as to be of such dimensions that they are electrically resonant at the design wavelength. By such a design, the apparatus may be configured as a band-pass or a band-stop filter, in which the effective extent of those elements is determined by the photonic illumination or current injection, and thereby the system is operated as an electromagnetic filter tuneable by photonic or electronic means.

FIGS. 8 and 9 show how a Vivaldi antenna array may be realised. More specifically, FIGS. 8 and 9 illustrate schematically how the slow wave effect may be used to steer a linear array of Vivaldi antenna elements when configured in a symmetric tri-plate form. The various components of the array are as stated in FIGS. 8 and 9.

Combinations of patch arrays based upon the present invention may be used in particular applications such for example as guidance radars. The concept is illustrated in FIG. 10, which shows four sub-arrays combined within a radome to provide the polarisation and monopulse capabilities of a future guidance radar.

System Overview

It will be appreciated from the description of the invention with reference to the accompanying drawings that the present invention is able to provide a microwave delay line with photon and/or electrical control of the velocity of propagation of an electromagnetic signal. Such apparatus lends itself to wide implementation, for example to the implementation of a dynamically steerable antenna through adjustment of the relative phase or time of excitation of constituent elements of the antenna. Generally, the apparatus of the invention may be used in adaptable resonators, filters, antennas, and other active and passive components. The apparatus may be used in a compact and monolithic form. The apparatus may be used in applications such for example as medical scanning, product inspection, collision avoidance radar, vehicle telematics, security and parameter protection, positioning and landing systems, telecommunications, aerospace systems, satellite communications, and mobile telephony.

It is to be appreciated that the embodiments of the invention described above with reference to the accompanying drawings have been given by way of example only and that modifications may be effected. Descriptions and details of well known components and techniques have generally not been described, unless they were required for further clarification of the construction and operation of the apparatus of the present invention. The apparatus of the present invention may be incorporated within systems of both flat or curved topology, and is thereby applicable to conformal structures.

What is claimed is:

1. Apparatus for providing a controllable signal delay along a transmission line, which apparatus comprises a transmission line conductor on a dielectric medium comprised wholly or partially of a semiconductor material, and adjacent periodically separated electromagnetically-coupled elements, the coupling between the elements and the transmission line conductor being controllable through photonic and/or electrical injection of electrical carriers into the dielectric medium, whereby the apparatus is such as to enable control of the velocity of electromagnetic propagation along the transmission line and thereby through the apparatus.

2. Apparatus according to claim 1 in which the transmission line conductor is a microstrip conductor.

3. Apparatus according to claim 2 in which the microstrip conductor has a structure comprising a thin metallic guide separated from a ground plane by a dielectric medium.

4. Apparatus according to claim 1 in which the transmission line conductor is an image line conductor, a fin line conductor, a slot line conductor, a coplanar waveguide conductor, an inverted microstrip conductor, a trapped inverted microstrip conductor, or a suspended strip line conductor.

5. Apparatus according to claim 1 in which the coupled elements are configured as arrays of slots or other electromagnetic structures.

6. Apparatus according to claim 1 in which the coupled elements are in a pattern which is such as to produce a controllable electromagnetic band-stop or band-pass filter.

7. Apparatus according to claim 1 and which is used to excite an array of antenna elements, thereby enabling controllable directivity of the array of antenna elements.

8. Apparatus according to claim 7 in which coupling to the antenna elements is enabled through locally generated filamentary plasmas.

9. Apparatus according to claim 1 and including optical means for generating locally generated filamentary plasma by the illumination of the dielectric medium.

10. Apparatus according to claim 1 and including electrical means for generating locally generated filamentary plasma by the injection of electrical carriers into the dielectric medium.

11. Apparatus according to claim 1 and including optical means and electrical means for generating locally generated filamentary plasma by illumination of the dielectric medium and electrical injection of electrical carriers into the dielectric medium.

12. Apparatus according to claim 7 in which the electromagnetic polarisation of the antenna is selectable through control of the coupling to the antenna elements.

13. Apparatus according claim to 1 and incorporated within a multiplicity of antenna sub-arrays, the collective effect of the sub-arrays enabling complex controllable antenna functionality.

14. Apparatus according to claim 1 and designed by calculation of geometry and material properties to perform in specific applications relating to telecommunications, radar, guidance, aerospace, medical scanning, inspection or other forms of sub-surface imaging.

* * * * *